US005613683A

United States Patent [19]

Ying et al.

[11] Patent Number: 5,613,683

[45] Date of Patent: Mar. 25, 1997

[54] SOCCER GAME APPARATUS

[76] Inventors: Ray C. Ying, 11511 Kingsbridge Dr., Richmond, BC, Canada, V7A 4T1; Alton M. Ying, 39C Broadway, 11th Floor, Mai Foo Sun Cheun, Kowloon, Hong Kong; Killian P. Ying, 284 Grace Dr., South Pasadena, Calif. 91030

[21] Appl. No.: 443,554

[22] Filed: May 18, 1995

[51] Int. Cl.[6] ..... A63F 7/06

[52] U.S. Cl. ..... 273/317.1; 273/108.5; 273/108.56; 273/129 P; 273/357; 273/108.1

[58] Field of Search ..... 273/317.1, 317.2, 273/317.3, 317.4, 317.5, 317.6, 108.56, 108.4, 108.5, 119 R, 126 R, 129 R, 129 P, 108.1, 120 A, 118 A, 126 A, 461, 353, 357, 317; 40/600, 606, 539

[56] References Cited

U.S. PATENT DOCUMENTS

| | | |
|---|---|---|
| 990,154 | 4/1911 | Mitchell . |
| 2,263,115 | 11/1941 | Winter . |
| 2,824,739 | 2/1958 | Frank . |
| 3,018,584 | 1/1962 | Passariello . |
| 3,899,173 | 8/1975 | Zaris . |
| 3,952,442 | 4/1976 | Livesey . |
| 4,262,905 | 4/1981 | Lyons . |
| 4,813,902 | 3/1989 | Messer . |
| 4,871,170 | 10/1989 | Carini . |
| 4,977,697 | 12/1990 | Genick . |
| 5,016,878 | 5/1991 | Hay . |
| 5,104,124 | 4/1992 | Bernard et al. . |
| 5,224,710 | 7/1993 | Feokhari . |
| 5,275,401 | 1/1994 | Liorens . |

FOREIGN PATENT DOCUMENTS

| | | |
|---|---|---|
| 45009 | 12/1931 | Denmark . |
| 506690 | 12/1954 | Italy . |
| 844321 | 8/1960 | United Kingdom . |

*Primary Examiner*—Sebastiano Passaniti

*Attorney, Agent, or Firm*—Christensen, O'Connor, Johnson & Kindness

[57] ABSTRACT

The sport of soccer is simulated with the aid of a representative playing field, a game ball, representative general athletes and representative goalkeepers. The general athletes are constructed from a resilient material such as cardboard, plastic, or sheet metal and are characterized by a concave-down shape defined by a leading member and a trailing member that are resiliently connected. In play, a general athlete is placed adjacent to the game ball such that its leading member abuts the ball. The player makes the athlete kick the game ball by striking a downward blow to the resilient connection, thereby propelling the leading and trailing members outward and upward and driving the abutted ball forward. A goalkeeper is constructed much like the general athlete except that it bears a first magnet. The player uses a second magnet on a control rod to drag the goalkeeper around the playing field by the first magnet.

34 Claims, 17 Drawing Sheets

SOCCER GAME APPARATUS

FIELD OF THE INVENTION

The present invention relates to the general field of game apparatus, and particularly to game apparatus for simulating the sport of soccer.

BACKGROUND OF THE INVENTION

A satisfying simulation of the game of soccer must reflect the fast pace and skill, both mental and physical, that are inherent in the sport; it must strike a suitable balance between accurate strategic simulation and real-time arcade-style simulation.

One popular arcade-style simulation is called table soccer, or "foosball". A foosball table includes rows of representative athletes, suspended like pendulums from control rods that are mounted transversely above a playing field. Players slide and rotate the control rods to make the athletes kick a small ball into the opposing team's goal. Although foosball is an enjoyable game in its own fight, it does not simulate soccer particularly accurately, beyond representing a ball being kicked into two nets by two opposing teams of athletes.

Recently, arcade-style simulations have also been implemented on computers and video games. These games can be designed to strike a good balance between strategic simulation and real-time simulation. However, current computer and video game technology is restricted to simulating events using visual cues on a video display unit and audible cues from speakers; a sense of space and touch and the excitement of physical competition are still difficult to recreate. The computer or video game equipment can be quite expensive and is often tethered to a computer monitor or a television set. Portable electronic games exist; however, they are not well suited for groups of people to play or for spectators to watch.

Strategic simulation soccer games exist in a form somewhat similar to role playing games. A team of athletes, represented by die cast models or little cardboard chits, is strategically placed on a playing field. The athletes are moved according to a set of rules, and the game is advanced using a randomizer to simulate the complex relationship between chance and physical interactions; a typical randomizer comprises a set of dice and a probability table. One such example is taught in U.S. Pat. No. 5,224,710 granted to Feokhari on Jul. 6, 1993 for a "Soccer Game Apparatus". These games can be cheaply made but lack the pace and physical skill of the sport being simulated.

Cardboard novelties have also been developed that simulate the behavior of a sports projectile such as a basketball or a baseball. U.S. Pat. No. 4,262,905 granted to Lyons on Apr. 21, 1981 for a "Paperboard Toy Projector" and U.S. Pat. No. 5,104,124 granted to Bernard et al. on Apr. 14, 1992 for a "Collapsible Game Usable as a Promotional Device," teach the construction of such novelties for baseball, golf and basketball. These novelties are cheap to produce and can be briefly captivating; however, they tend to be target type games in their own right and not elements of a sports simulation which can sustain interest for longer periods.

SUMMARY OF THE INVENTION

The present invention provides apparatus for simulating the sport of soccer, such apparatus being in a form that is inexpensive and portable, and which strikes an exciting balance between pacing, physical skill and mental skill.

According to one embodiment of the invention, there is provided a simulated soccer game, comprising a representative playing field having soccer field indicia thereon, a representative game ball operable to roll along the playing field, a representative goal operable to receive the game ball, and a representative athlete, operable to propel the game ball, wherein the athlete is characterized by a substantially concave-down shape defined by a leading member having a leading portion and a trailing portion, a trailing member having a leading portion and a trailing portion, and means for resiliently connecting the trailing portion of the leading member to the leading portion of the trailing member.

According to another embodiment of the invention, there is provided a representative athlete for use in a sports simulation operable to propel a game projectile over a playing surface, wherein the athlete is characterized by a substantially concave-down shape defined by a leading member having a leading portion and a trailing portion, a trailing member having a leading portion and a trailing portion, and means for resiliently connecting the trailing portion of the leading member to the leading portion of the trailing member.

According to yet another embodiment of the invention, there is provided an apparatus for controlling the movement of a magnetic representative athlete over a playing surface in a sports simulation, comprising a elongated control rod, the control rod having a proximate end and a magnetic distal end, the magnetic distal end being operable to magnetically couple the athlete to the proximate end.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
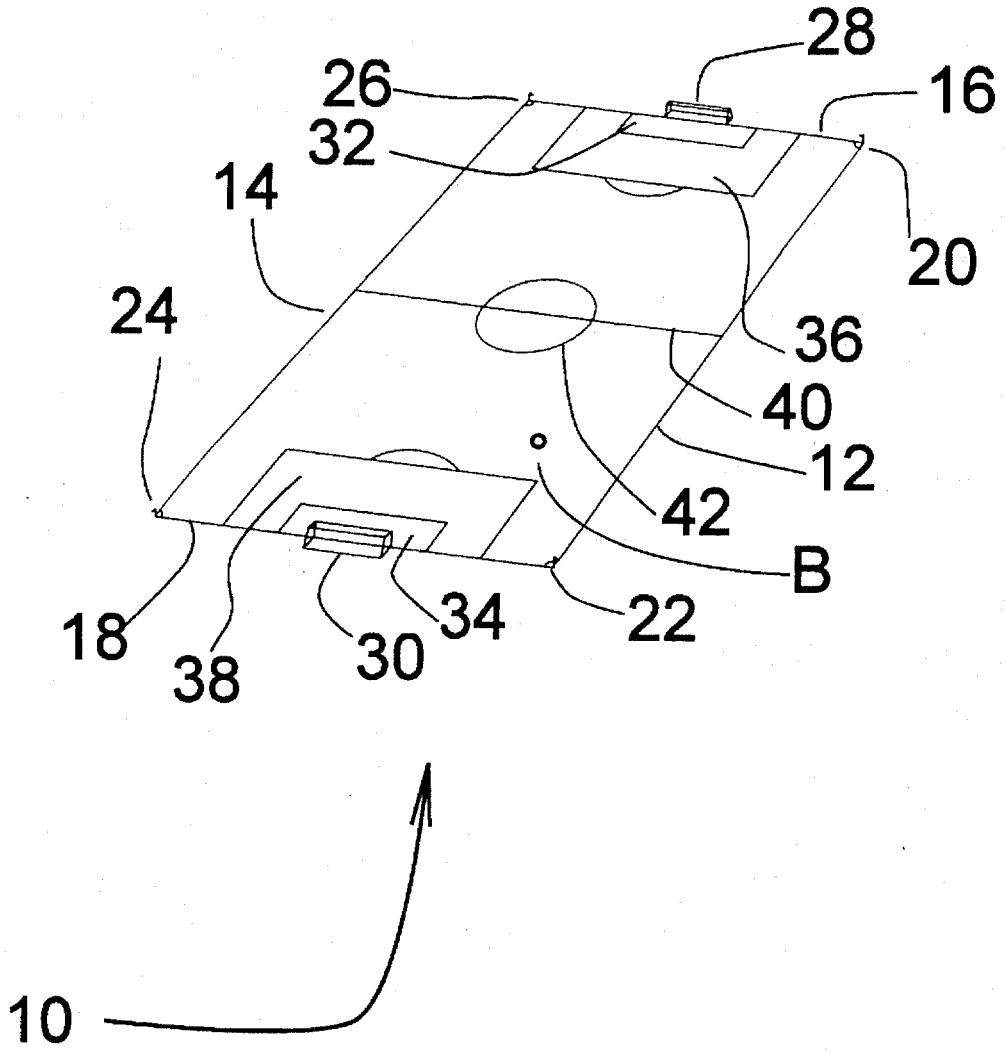
FIG. 1 is a top perspective of a representative soccer playing field, being one element of one embodiment of the present invention.

With reference now to FIG. 1, a representation of a soccer field is generally illustrated at 10. The field 10 includes indicia formed on a base sheet, including first and second touchlines 12, 14, both having the same scale length selected within the range of 100 to 130 yards and first and second goal lines 16, 18, both having the same scale length, selected within the range of 50 to 100 yards. The first and second touchlines 12 and 14 and the first and second goal lines 16, 18 form a rectangle, thereby setting the outer boundaries of the field 10. First, second, third and fourth corner flags 20, 22, 24, 26 are placed respectively at each of the four intersections of the first and second touchlines 12, 14 and the first and second goal lines 16, 18.

First and second goal nets 28, 30 are centered respectively along the first and second goal lines 16, 18, each goal net 28, 30 opening inward toward the center of the field 10 and having a scale height of 8 feet and a scale width of 24 feet. The first and second goal nets 28, 30 open onto respectively first and second goal areas 32, 34 and first and second penalty areas 36, 38. The first and second goal areas 32, 34 each have a scale width of 20 yards and a scale depth of 6 yards. The first and second penalty areas 36, 38 each have a scale width of 44 yards and a scale depth of 18 yards. The first and second goal nets 28, 30 may be constructed of such materials as paper, cardboard, plastic, fabric or metal, preferably with rear and side webbing to represent the net of a soccer goal.

A center line 40 runs parallel to the first and second goal lines 16, 18 from the midpoint of the first touchline 12 to the midpoint of the second touchline 14, thereby bisecting the field 10. A center circle 42 is located on the field 10 such that its center point is coincident with the midpoint of the center line 40.

The field 10 can be constructed in a number of embodiments. It has been found that preferred actual dimensions for the field 10 are 9 feet by 5 feet, 6 feet by 3 feet, and 4 feet by 2 feet. In a particularly simple and portable embodiment, a swatch of material such as felt or baize can be lined in the pattern described above and unrolled onto any flat surface for use. In a more elaborate embodiment, further described below with reference to FIG. 10, the swatch can be affixed to a backing sheet of a material such as wood, plastic, cardboard or slate and built into a table similar to a pool table.

Playing surfaces other than felt or baize are contemplated, and include fabric, cardboard, and wallpaper. The key to selecting the playing surface is that the coefficient of friction between the playing surface and the game ball must be such that the game ball travels appropriate scale distances during the course of play. A ball that is compatible with the above playing surfaces is BB sized (approximately 0.18 inch in diameter, but different sizes may be used), and made of either rough plastic or rubber.

Figure 2:
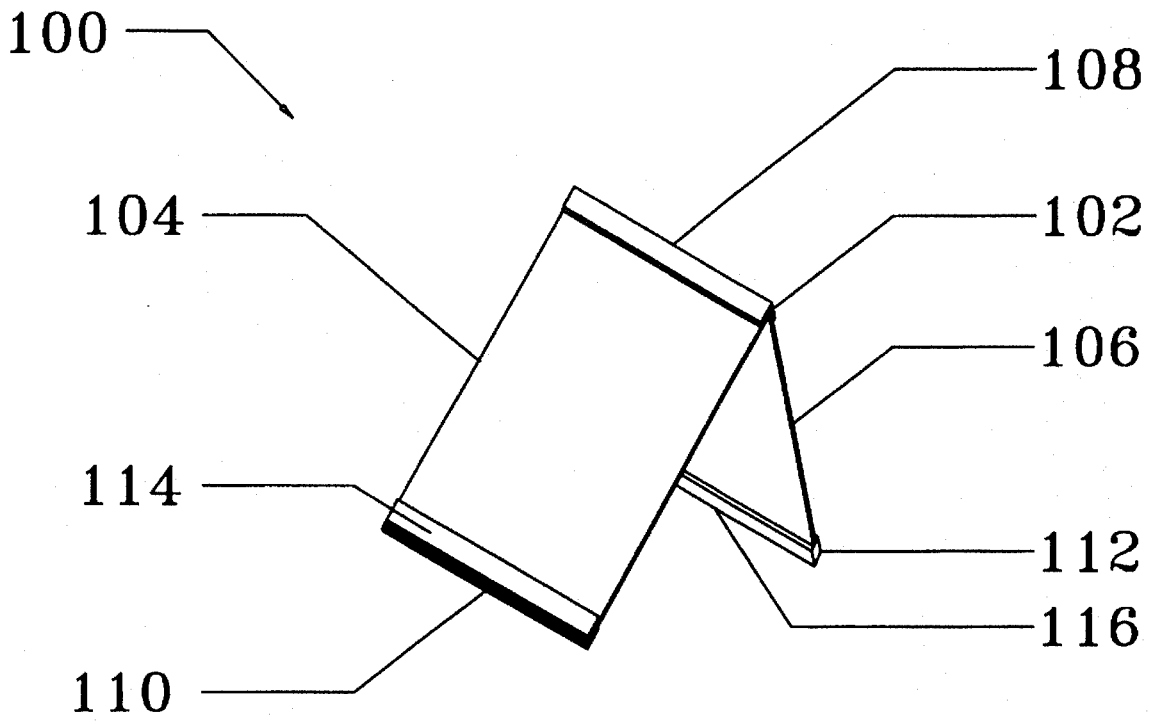
FIG. 2 is a top front perspective of a first embodiment of a representative soccer athlete for use with the field of FIG. 1.
Figure 3:
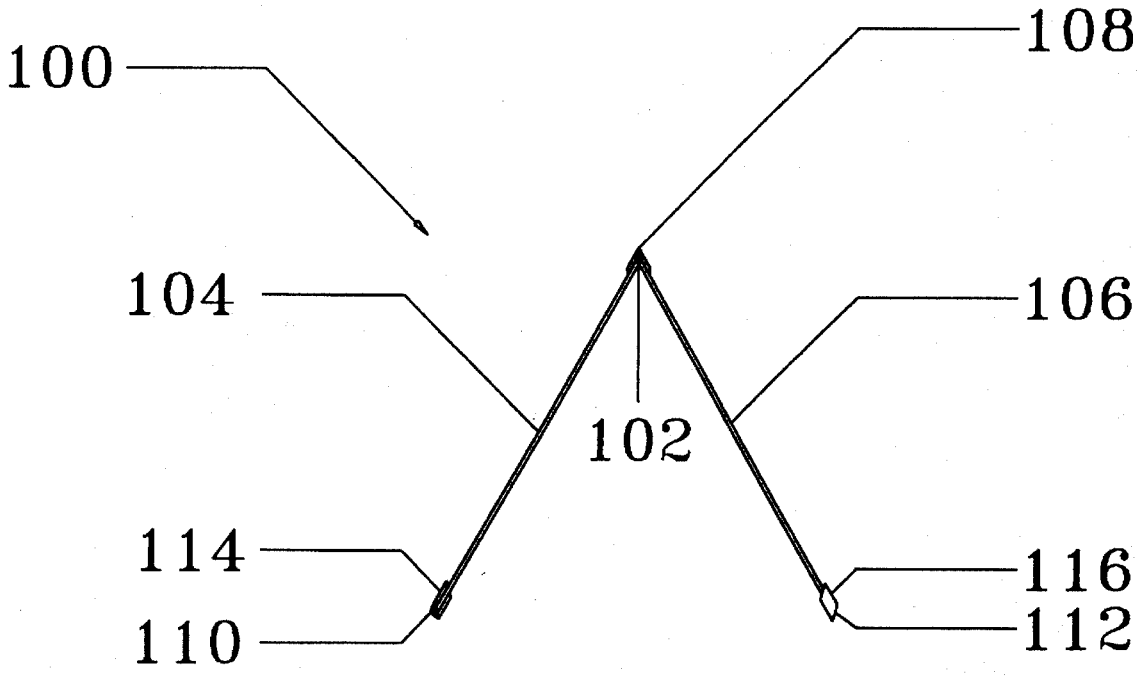
FIG. 3 is a side elevation of the athlete of FIG. 2.

With reference now to FIGS. 2 and 3, a first embodiment of a representation of a soccer athlete is generally illustrated at 100. The athlete 100 is formed from an elongated resilient sheet of a material such as cardboard, plastic, rubber, or sheet metal and has a scale height of approximately 5'6" to 6'2". A fold or bend 102 defines the athlete 100 as an inverted V shape, having a front panel 104 and a back panel 106 defining the angled legs of the V. The fold 102 is supplemented with a first overlaid reinforcement strip 108 of a material such as tape or matting. The front panel 104 is further defined by a leading edge 110, and the back panel 106 is further defined by a trailing edge 112. The leading edge 110 and the trailing edge 112 are supplemented with overlaid second and third reinforcement strips 114, 116 of a material such as tape or matting. The colors of the front and back panels 104, 106 and the reinforcement strips 108, 114, 116 can be selected to indicate team colors as on jerseys and shorts.

Figure 4:
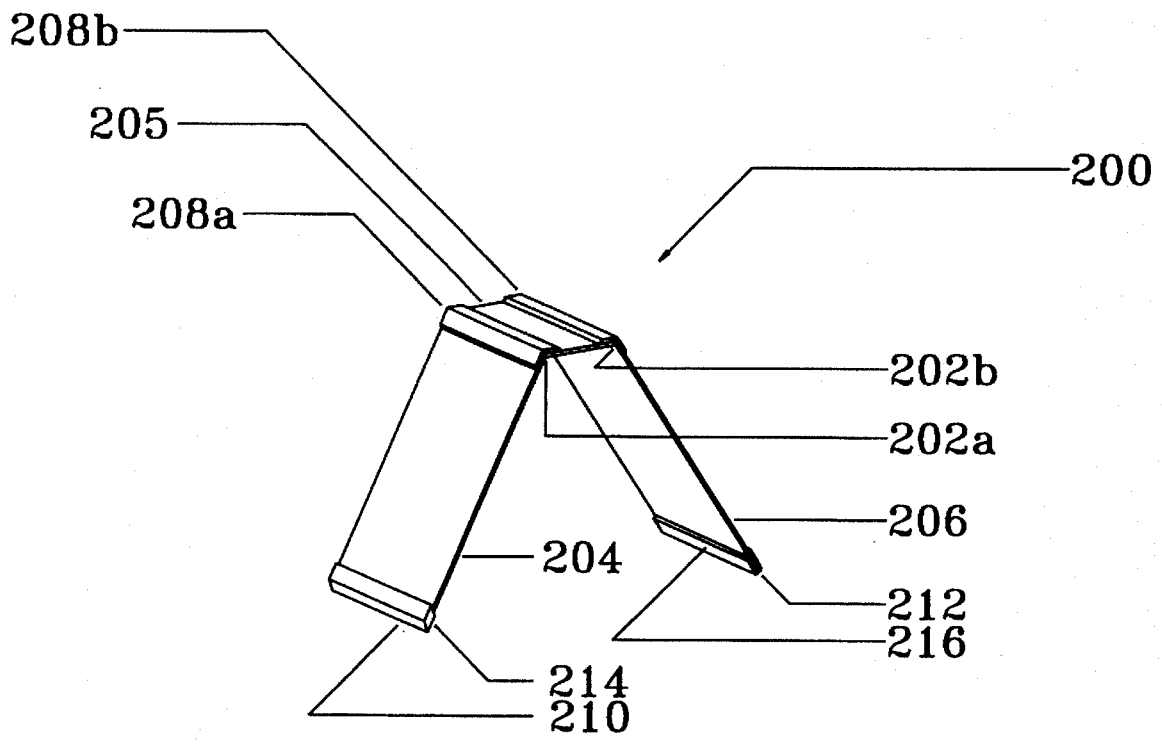
FIG. 4 is a top front perspective of a second embodiment of a representative soccer athlete for use with the field of FIG. 1.
Figure 5:
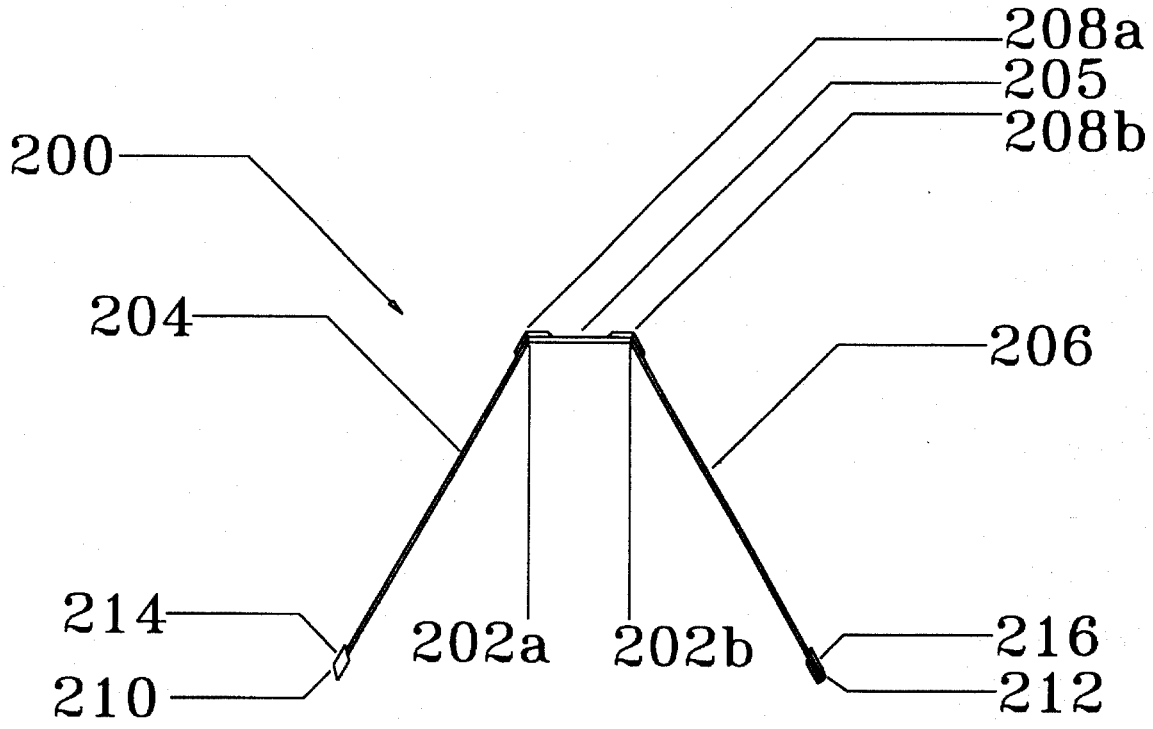
FIG. 5 is a side elevation of the athlete of FIG. 4.

With reference now to FIGS. 4 and 5, a second embodiment of a representation of a soccer athlete is generally illustrated at 200. The athlete 200 is formed from an elongated resilient sheet of a material such as cardboard, plastic, rubber, or sheet metal and has a scale height of approximately 5'6"to 6'2". Two folds or bends 202*a*, 202*b* define the athlete 200 as an truncated inverted V shape, having a front panel 204, a top panel 205, and a back panel 206. The folds 202*a*, 202*b* are supplemented with first and second overlaid reinforcement strips 208*a*, 208*b* of a material such as tape or matting. The front panel 204 is further defined by a leading edge 210, and the back panel 206 is further defined by a trailing edge 212. The leading edge 210 and the trailing edge 212 are supplemented with third and fourth overlaid reinforcement strips 214, 216 of a material such as tape or matting. The colors of the front and back panels 204, 206 and the reinforcement strips 208*a*, 208*b*, 214, 216 can be selected to indicate team colors as on jerseys and shorts.

Figure 6:
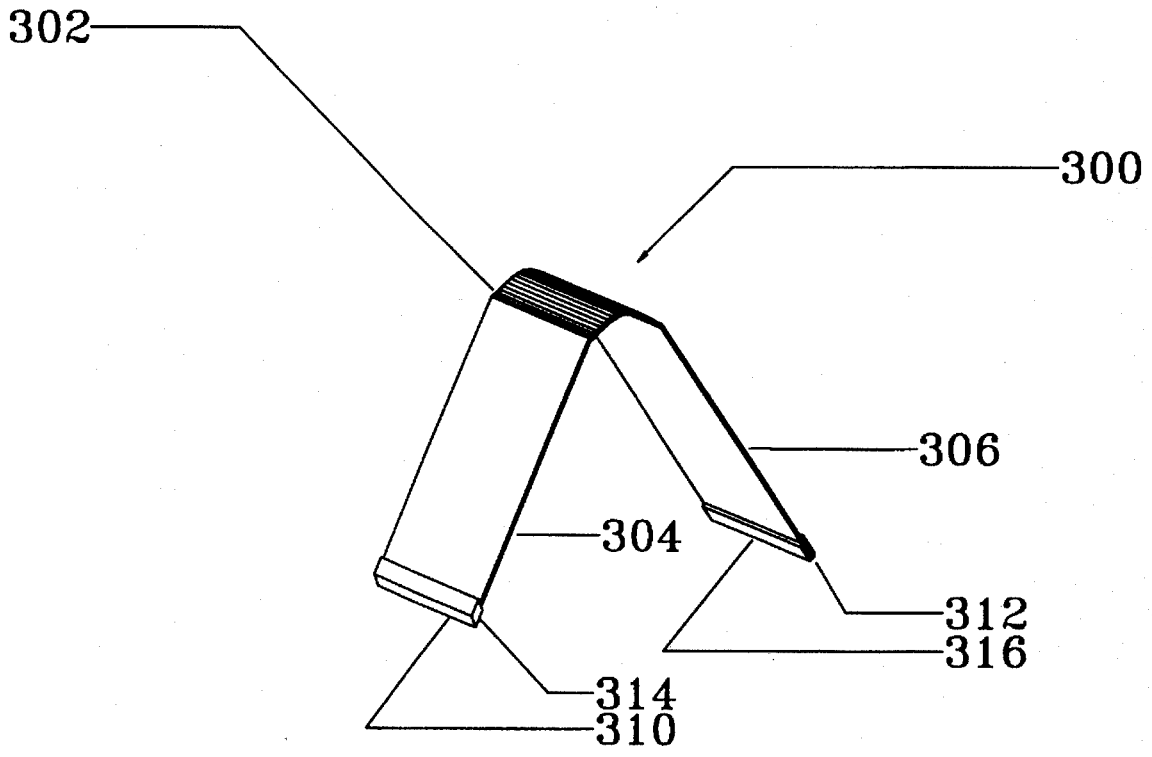
FIG. 6 is a top front perspective of a third embodiment of a representative soccer athlete for use with the field of FIG. 1.
Figure 7:
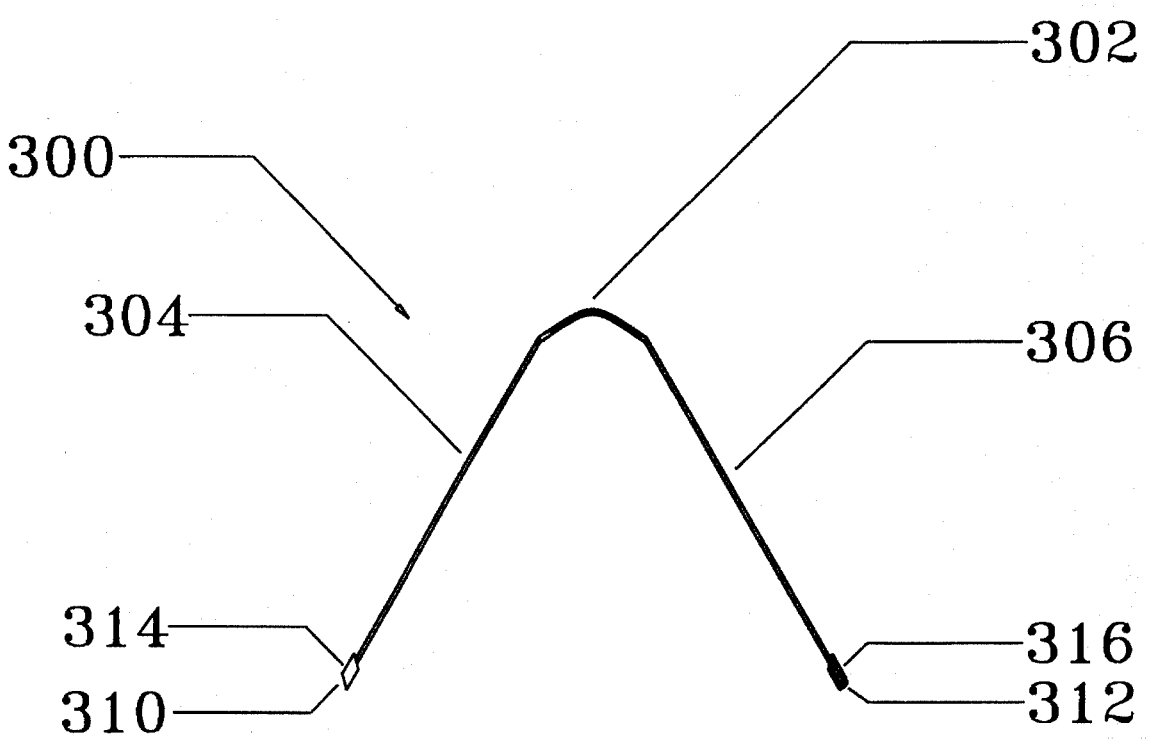
FIG. 7 is a side elevation of the representative athlete of FIG. 6.

With reference now to FIGS. 6 and 7, a third embodiment of a representation of a soccer athlete is generally illustrated at 300. The athlete 300 is formed from an elongated resilient sheet of a material such as cardboard, plastic, rubber, or sheet metal and has a scale height of approximately 5'6" to 6'2". A continuous bend or arcuate "fold" 302 defines the athlete 300 as an inverted U shape, having a front panel 304 and a back panel 306 which merge smoothly into the continuous bend 302. The front panel 304 is further defined by a leading edge 310, and the back panel 306 is further defined by a trailing edge 312. The leading edge 310 and the trailing edge 312 are supplemented with first and second overlaid reinforcement strips 314, 316 of a material such as tape or matting. The colors of the front and back panels 304, 306 and the reinforcement strips 314, 316 can be selected to indicate team colors as on jerseys and shorts.

Figure 8:
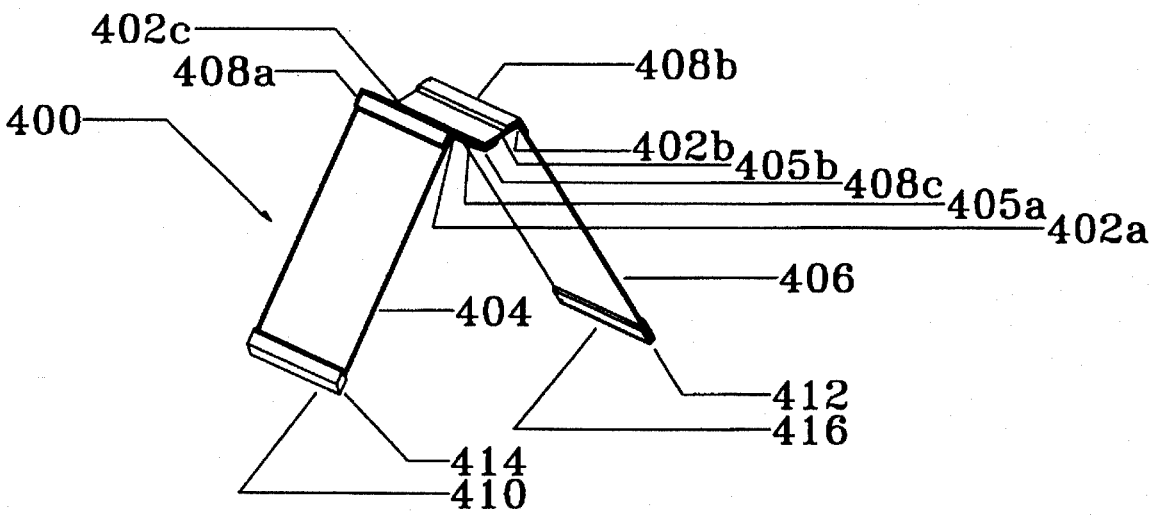
FIG. 8 is a top front perspective of a forth embodiment of a representative athlete for use with the field of FIG. 1.
Figure 9:
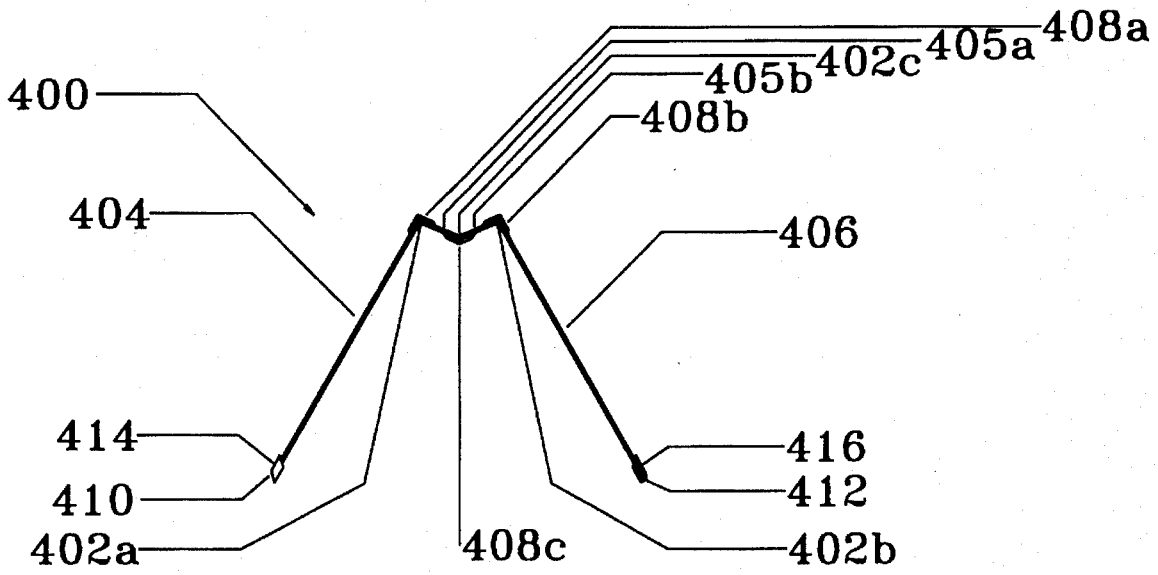
FIG. 9 is a side elevation of the representative athlete of FIG. 8.

With reference now to FIGS. 8 and 9, a fourth embodiment of a representation of a soccer athlete is generally illustrated at 400. The athlete 400 is formed from an elongated resilient sheet of a material such as cardboard, plastic, rubber, or sheet metal and has a scale height of approximately 5'6" to 6'2". Three folds or bends 402*a*, 402*b*, 402*c* define the athlete 400 as an inverted W shape, having a front panel 404, first and second top panels 405*a*, 405*b*, and a back panel 406. The folds 402*a*, 402*b*, 402*c* are supplemented with first, second and third overlaid reinforcement strips 408*a*, 408*b*, 408*c* of a material such as tape or matting. The front panel 404 is further defined by a leading edge 410, and the back panel 406 is further defined by a trailing edge 412. The leading edge 410 and the trailing edge 412 are supplemented with fourth and fifth overlaid reinforcement strips 414, 416 of a material such as tape or matting. The colors of the front and back panels 404, 406 and the reinforcements 408*a*, 408*b*, 408*c*, 414, 416 can be selected to indicate team colors as on jerseys and shorts.

Figure 10:
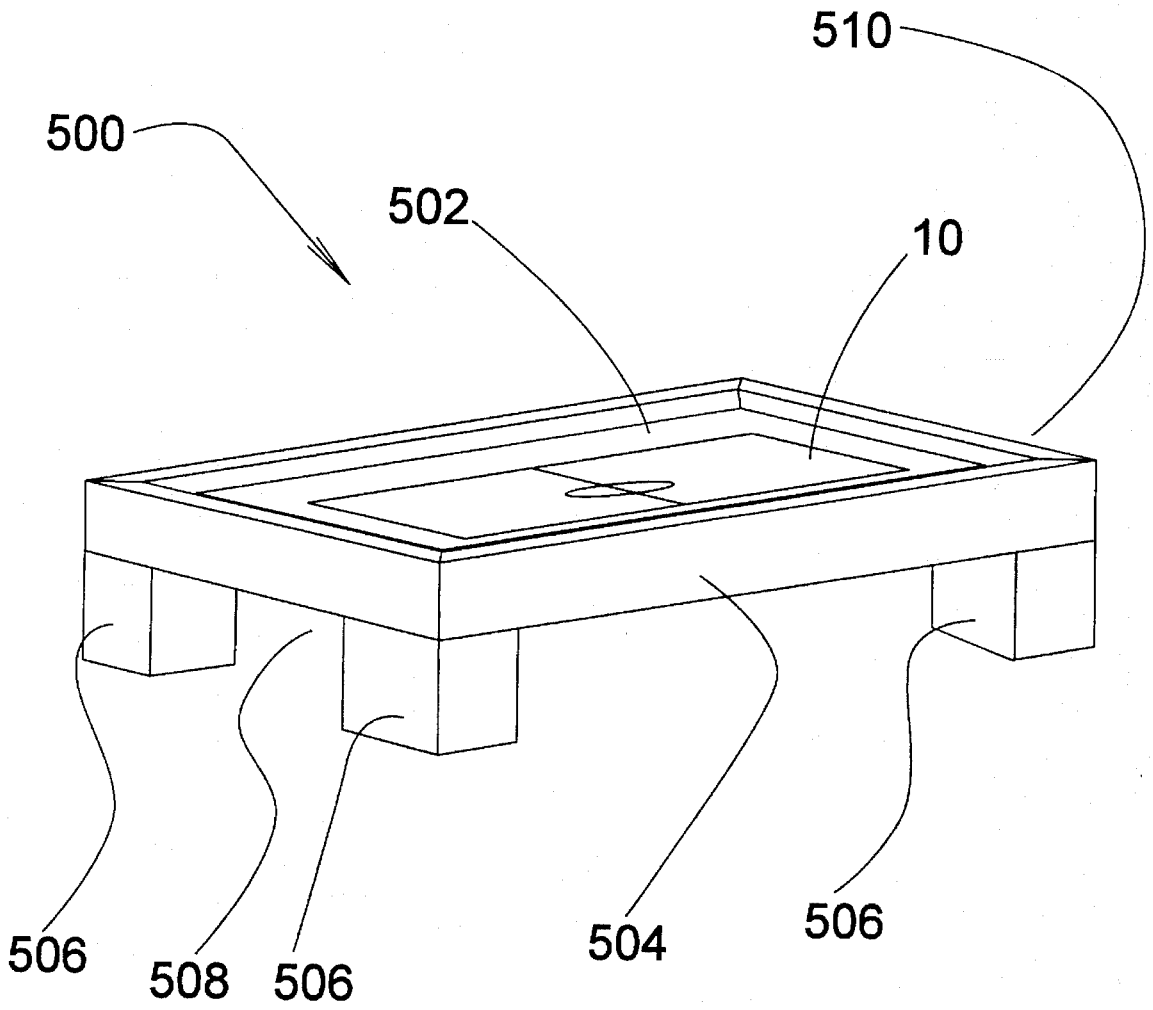
FIG. 10 is a top perspective of a playing table supporting the representative playing field of FIG. 1.
Figure 11:
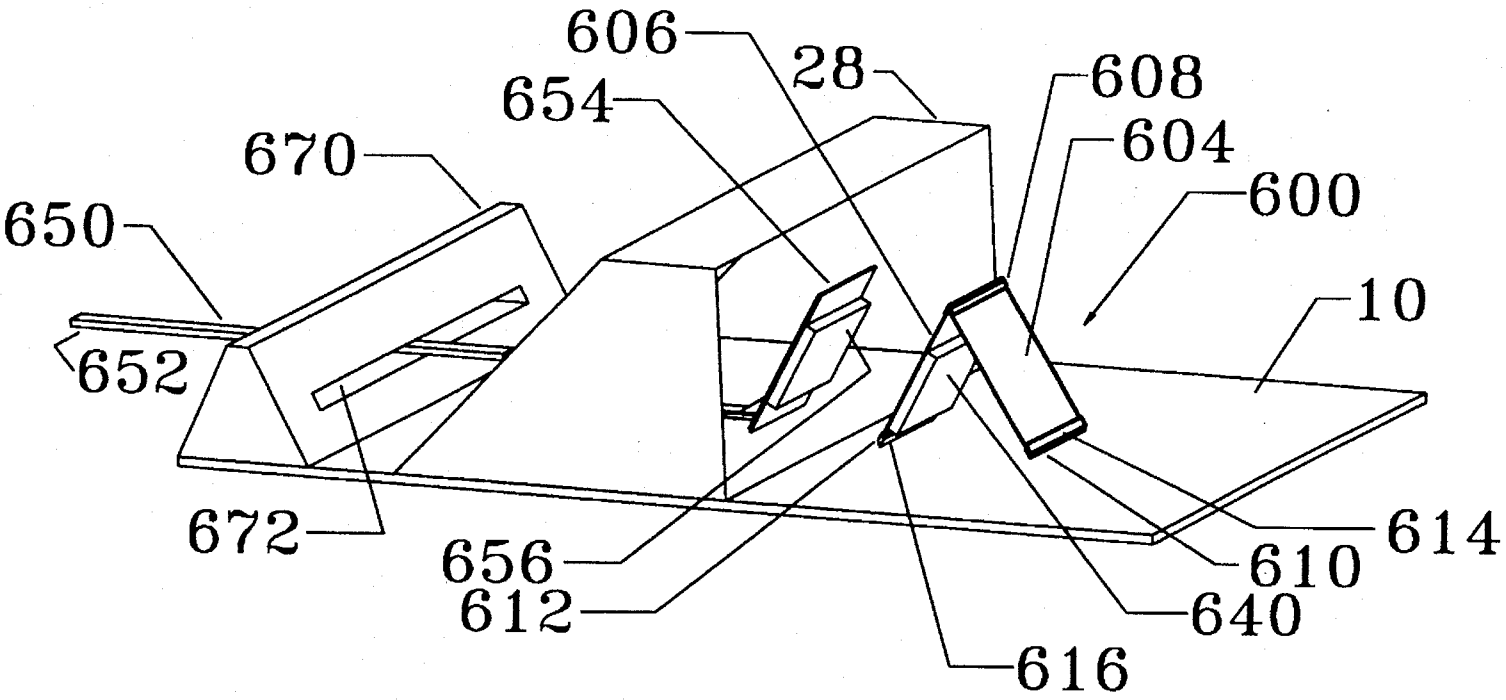
FIG. 11 is a top front perspective of a first embodiment of a magnetic representative goalkeeper and its magnetic control member, for use with the representative playing field of FIG. 1.
Figure 12:
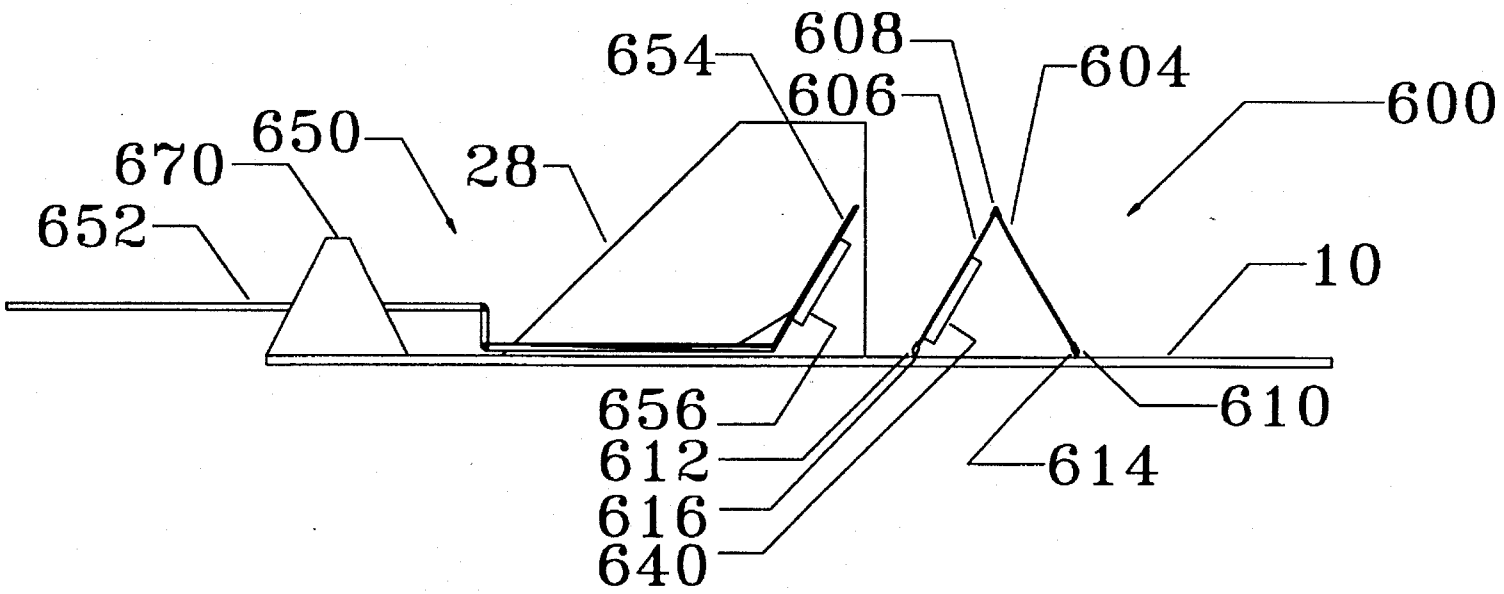
FIG. 12 is a side elevation of the representative goalkeeper and magnetic control member of FIG. 11.
Figure 13:
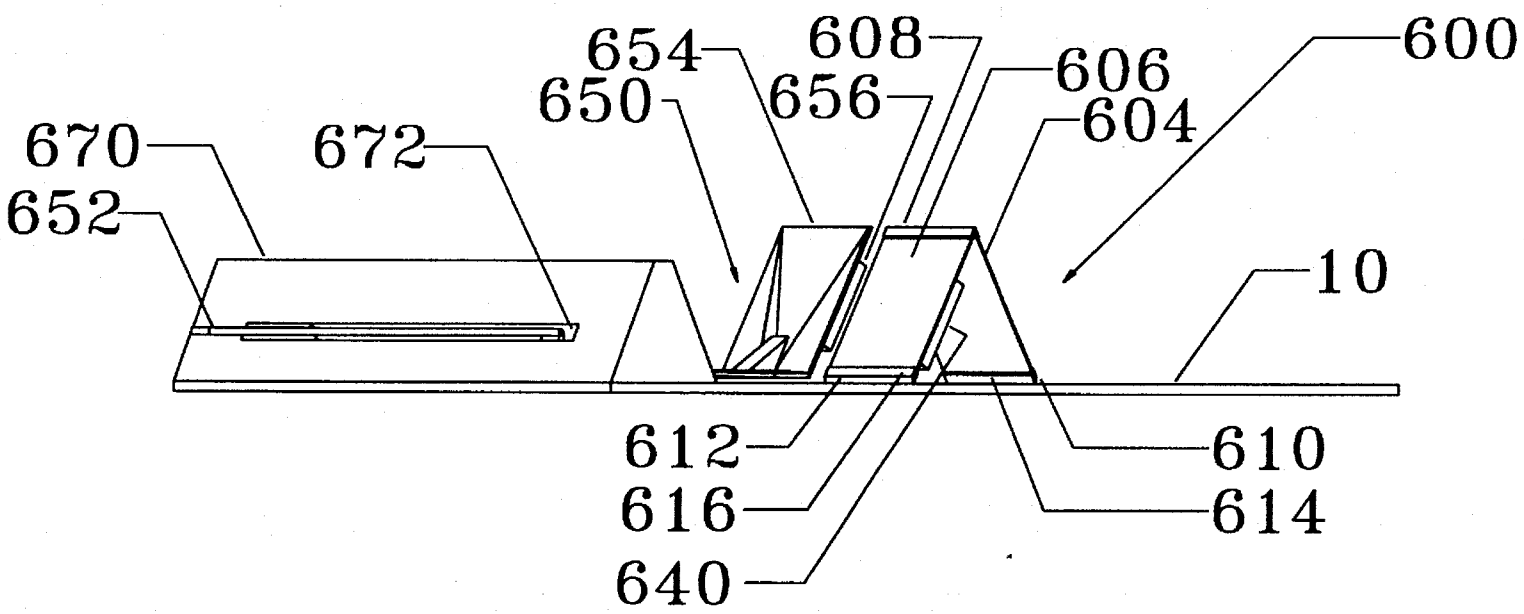
FIG. 13 is an elevation of the representative goalkeeper and magnetic control member of FIG. 11, but taken at an angle to FIG. 12.
Figure 14:
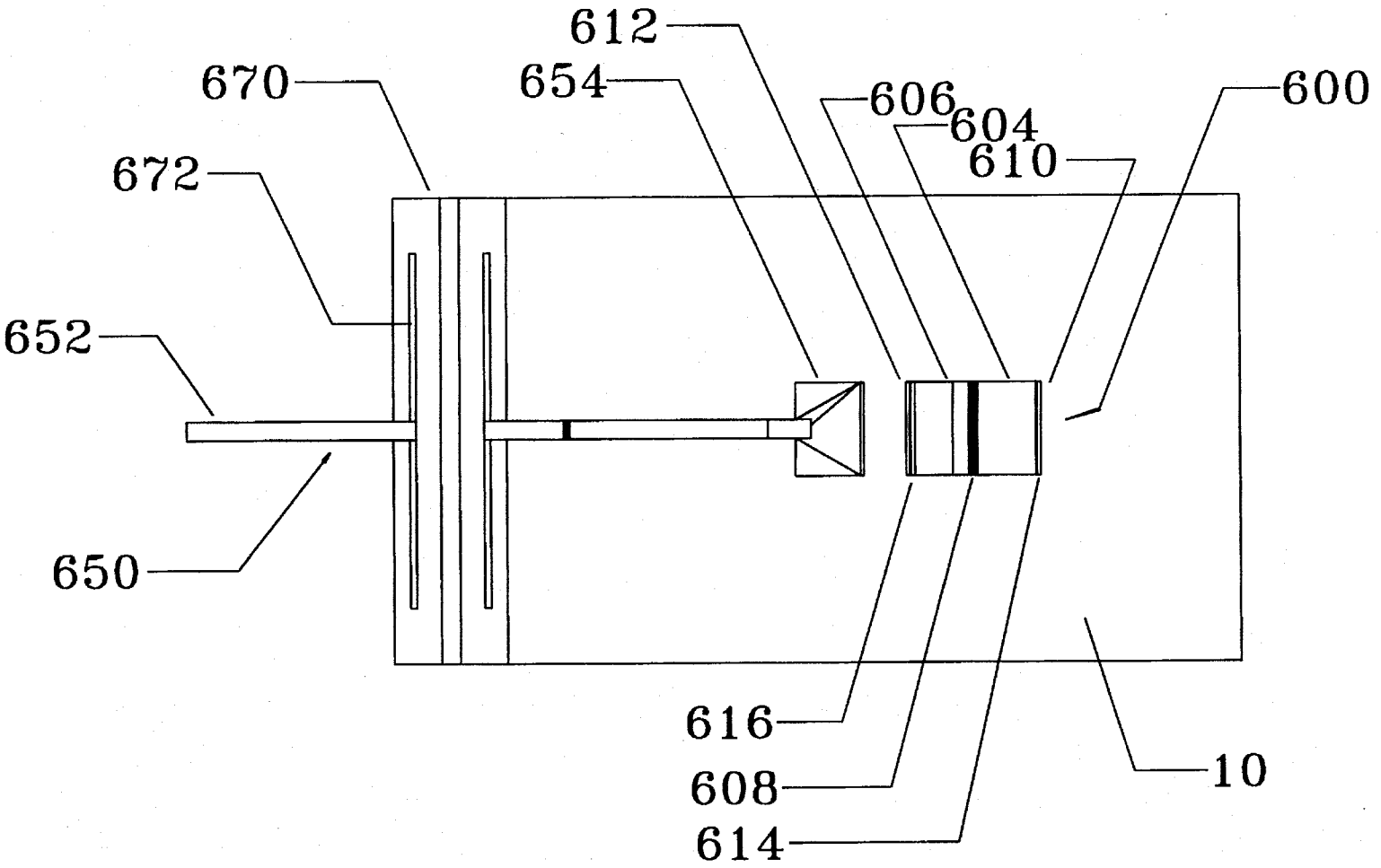
FIG. 14 is a top plan of the magnetic goalkeeper and magnetic control member of FIG. 11.

With reference now to FIG. 10, the base sheet of the field 10 is shown affixed to a game table generally illustrated at 500. The table 500 includes a bed 502 supporting the base sheet, a frame 504 attached to the bed 502 and surrounding the field 10, and a set of supporting legs 506 attached to the underside of the bed 502 to elevate the table 500. First and second accessways 508, 510 are provided at either end of the table 500 to allow players to remotely control representative goalkeepers (not shown), as will be more fully discussed below with reference to FIGS. 15–17.

The frame 504 provides support and also helps to keep the game ball B from leaving the field 10, functioning much like the walls of a stadium. The supporting legs 506 may be fixed, foldable, or removable. Short supporting legs 506, as shown in FIG. 18, would be appropriate for use in combination with a table such as a kitchen table, a dining table or a coffee table. Longer supporting legs 506 would be appropriate for elevating the bed 502 well above a floor, much in the fashion of a pool table.

Any representative athlete 100, 200, 300, 400 can be used also to represent a goalkeeper. Although such a goalkeeper could be controlled directly by a player's hand, the hand might unrealistically interfere with the course of play. Therefore various arrangements for remotely controlling the goalkeeper may be desirable.

With reference to FIGS. 11 through 14, a first embodiment of a magnetically controlled goalkeeper will now be described. The goalkeeper, generally illustrated at 600 is very similar to the general athlete 100. The goalkeeper 600 includes a front panel 604 and a back panel 606, joined at the top edges by a fold or bend 602. The fold 602 includes a overlaid reinforcement strip 608 of a material such as tape or matting. The front panel 604 is further defined by a leading edge 610, and the back panel 606 is further defined by a trailing edge 612. The leading edge 610 and the trailing edge 612 are supplemented with second and third overlaid reinforcement strips 614, 616 of a material such as tape or matting. Unlike the general athlete 100, the goalkeeper 600 includes a first magnet 640 attached to the inside surface of the back panel 606.

A control rod for moving the goalkeeper 600 is illustrated generally at 650. The control rod 650 includes a handle portion 652 at its proximate end and a substrate portion or upturned flange 654 at its distal end. A second magnet 656 is mounted to the control rod 650 on the flange 654. The second magnet 656 is polarized so as to attract the first magnet 640 when the control rod 650 is placed behind the goalkeeper 600. The handle portion 652 is shaped so as to slip Beneath the back bottom edge of the goal net 28, 30 (goal 28 being shown in FIGS. 11 and 12) and through a slot 672 in a mounting block 670 located behind the goal. The slot 672 in the mounting block 670 constrains the control rod 650 to move in a plane parallel to the playing surface of the field 10 and having boundaries substantially coincident with the boundaries of the goal area 32, 34.

Figure 15:
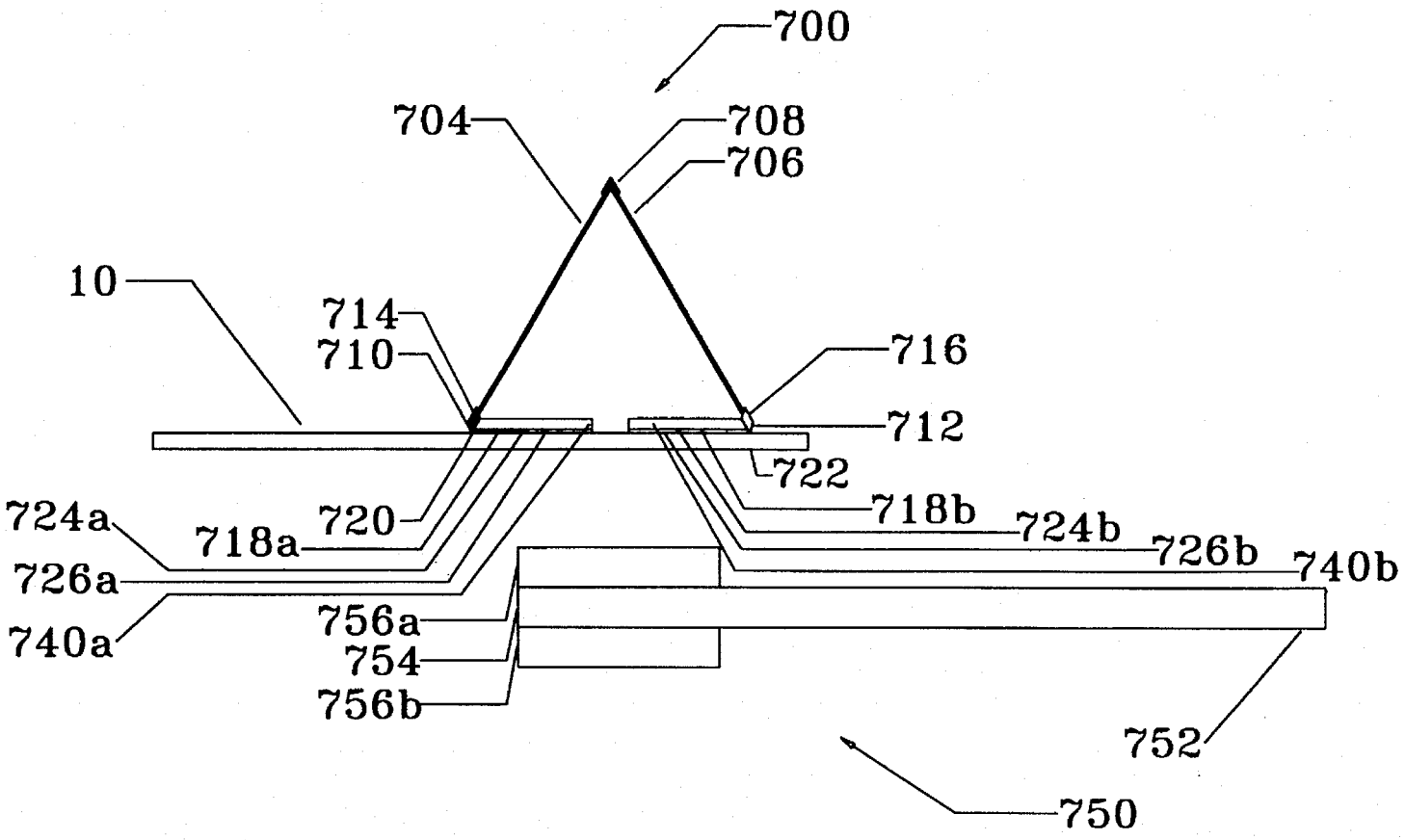
FIG. 15 is a side elevation of a second embodiment of a magnetic representative goalkeeper and its magnetic control member, for use with the playing table of FIG. 10.
Figure 16:
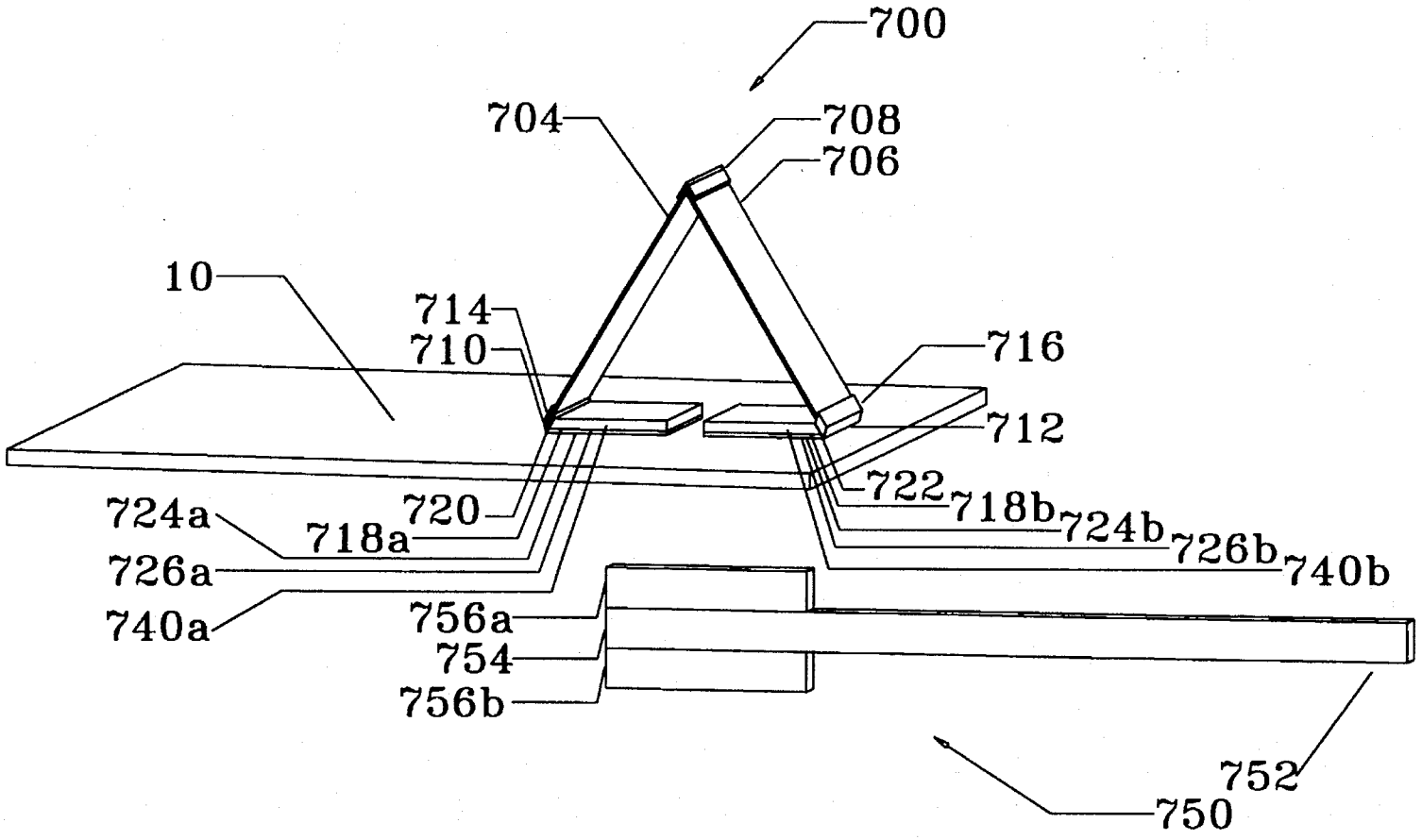
FIG. 16 is an elevational view of the magnetic goalkeeper and magnetic control member of FIG. 15, but taken at an angle thereto.

With reference to FIGS. 15 and 16, a second embodiment of a magnetically controlled goalkeeper will now be described. The goalkeeper, generally illustrated at 700, is very similar to the general athlete 100. The goalkeeper 700 includes a from panel 704 and a back panel 706, joined at the top edges by a fold or bend 702. The fold 702 includes a first overlaid reinforcement strip 708 of a material such as tape or matting. The front panel 704 is further defined by a leading edge 710, and the back, panel 706 is further defined by a trailing edge 712. The leading edge 710 and the trailing edge 712 are supplemented with second and third overlaid reinforcement strips 714, 716 of a material such as tape or matting.

Unlike the general athlete 100, the goalkeeper 700 further includes a leading bottom horizontal panel 718*a* having a forward edge 720, and a trailing bottom horizontal panel 718*b* having a rear edge 722. The forward edge 720 of the leading bottom panel 718*a* is adjacent to the leading edge 710 of the front panel 704, and the rear edge 722 of the trailing bottom panel 718*b* is adjacent to the trailing edge 712 of the back panel 706. The forward edge 720 and the leading edge 710 may meet in either a fold or a joint, either of which may be reinforced. The rear edge 722 and the trailing edge 712 may meet in either a fold or a joint, either of which may be reinforced. The bottom panels 718*a* and 718*b* each have an upper surface 724*a*, 724*b* and a lower surface 726*a*, 726*b*. Two goalkeeper magnets 740*a*, 740*b* may be mounted to the bottom panels, on either the upper surfaces 724*a*, 724*b* or the lower surfaces 726*a*, 726*b*, although the upper surfaces 724*a*, 724*b* are preferred. The magnetic fields of the two goalkeeper magnets 740*a*, 740*b* are aligned normal to the two bottom panels 718*a*, 718*b* and are similarly polarized.

A control rod for moving the goalkeeper 700 is illustrated generally at 750. The control rod 750 includes a handle portion 752 at its proximate end and a substrate portion 754 at its distal end. Two control rod magnets 756*a*, 756*b* are mounted on opposite faces of the substrate portion 754, such that their magnetic fields are aligned normal to the mounting faces and are similarly polarized. The control rod 750 is shaped and sized to fit through the first and second accessways 508, 510 found on the playing table 500. The handle portion 752 is accessible to a game player (not shown) over the whole range of allowable control rod magnet 756*a*, 756*b* positions as circumscribed by the boundaries of the goal area 32, 34. The goalkeeper magnets 740*a*, 740*b* and the control rod magnets 756*a*, 756*b* are selected to provide reliable and responsive coupling through the bed 502 of playing table 500. Because the magnetic fields of the pair of control rod magnets 756*a*, 756*b* are aligned and similarly polarized, when the control rod 750 is placed in use below the goalkeeper 700, the two goalkeeper magnets 740*a*, 740*b* will either pull the goalkeeper 700 toward the control rod 750 or push the goalkeeper 700 away from the control rod 750 depending on the orientation of the control rod 750.

Figure 17:
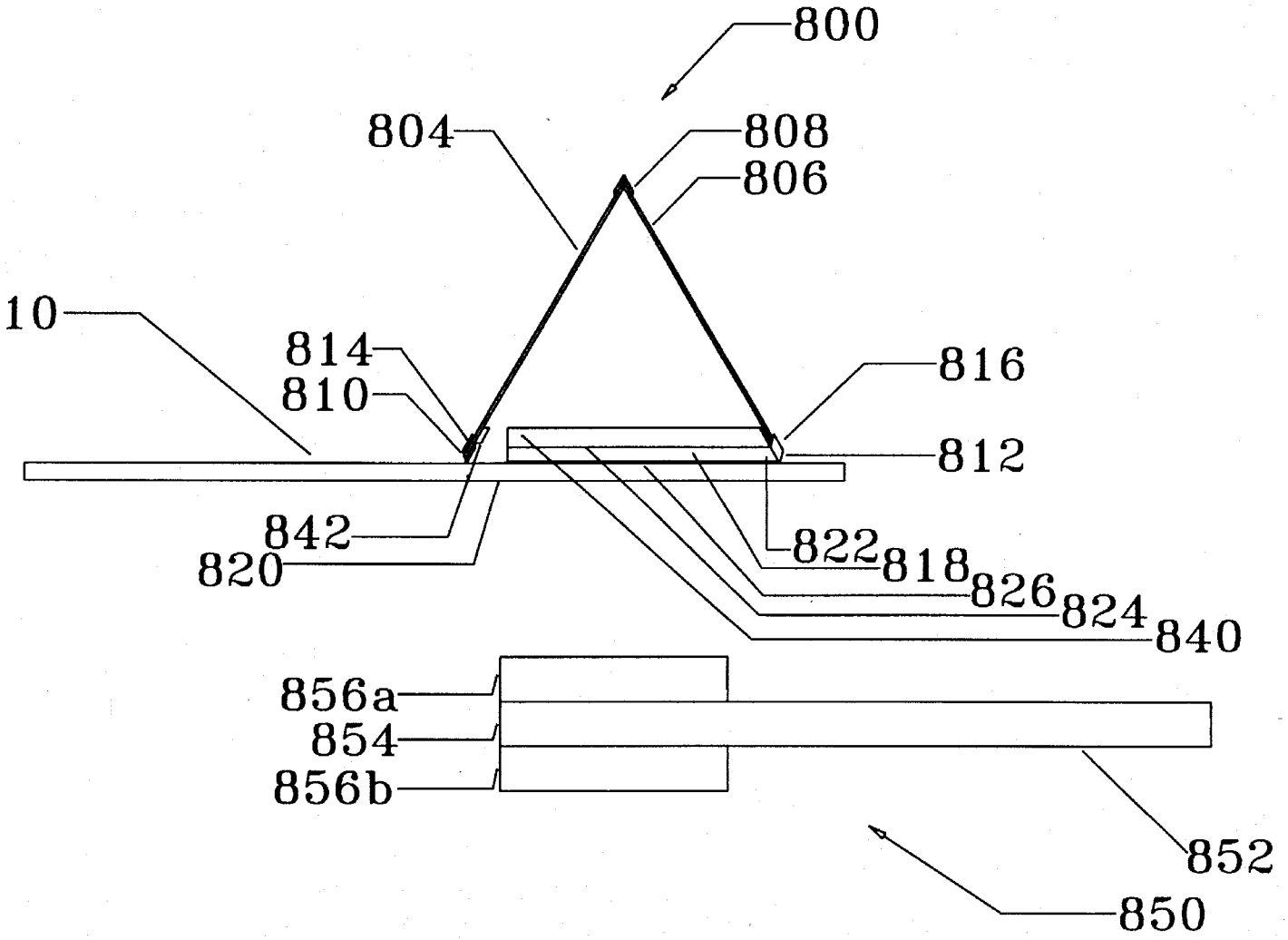
FIG. 17 is a side elevation of a third embodiment of a magnetic goalkeeper and magnetic control member for use with the playing table of FIG. 10.

With reference to FIG. 17, a preferred goalkeeper is generally illustrated at 800. The representative goalkeeper 800 is very similar to the general athlete 100. The goalkeeper 800 includes a front panel 804 and a back panel 806, joined at the top edges by a fold or bend 802. The fold 802 includes a first overlaid reinforcement strip 808. The front panel 804 is further defined by a leading edge 810, and the back panel 806 is further defined by a trailing edge 812. The leading edge 810 and the trailing edge 812 are supplemented with second and third overlaid reinforcement strips 814, 816 of a material such as tape or matting.

Unlike the general athlete 100, the goalkeeper 800 further includes a bottom panel 818 having a forward edge 820 and a rear edge 822. The forward edge 820 is adjacent to the leading edge 810 of the front panel 804 and the rear edge 822 is adjacent the trailing edge 812 of the back panel 806. The forward edge 820 and the leading edge 810 are not connected. The rear edge 822 and the trailing edge 812 may meet in either a fold or a joint, either of which may be reinforced. The bottom panel 818 has an upper surface 824 and a lower surface 826. A goalkeeper magnet 840 may be mounted on either the upper surface 824 or the lower surface 826, although the upper surface 824 is preferred. The magnetic field of the goalkeeper magnet 840 is aligned normal to the bottom panel 818. A thin magnetic strip 842 is mounted on the inside surface of the front panel 804, proximate to the leading edge 810. The magnetic strip 842 is polarized so as to be attracted to the goalkeeper magnet 840, thereby releasably coupling the front panel 804 to the bottom panel 818.

A control rod for moving the goalkeeper 800 is illustrated generally at 850. The control rod 850 includes a handle portion (not shown) at its proximate end and a substrate portion 854 at its distal end. Two control rod magnets **856*a*, 856*b* are mounted on opposite faces of the substrate portion 854, such that their magnetic fields are aligned normal to the mounting faces and are similarly polarized. The control rod 850 is shaped and sized to fit through the first and second accessways 508, 510 found on the playing table 500. The handle portion is accessible to a game player (not shown) over the whole range of allowable control rod magnet 856*a*, 856*b* positions as circumscribed by the boundaries of the goal area 32, 34. The goalkeeper magnet 840 and the pair of control rod magnets 856*a*, 856*b* are selected to provide reliable and responsive coupling through the bed 502 of playing table 500. Because the magnetic fields of the pair of control rod magnets 856*a*, 856*b* are aligned and similarly polarized, when the control rod 850 is placed in use below the goalkeeper 800, the goalkeeper magnet 840 will either pull the goalkeeper 800 toward the control rod 850 or push the goalkeeper 800 away from the control rod 850 depending on the orientation of the control rod 850**.

The above described magnetic goalkeeper embodiments 600, 700, 800 were developed from the inverted V-shape embodiment of the general representative athlete 100. Within the spirit of the invention, further embodiments of magnetic goalkeepers could be developed from other geometries, including the truncated inverted V-shaped athlete 200, the inverted U shaped athlete 300 and the inverted W-shaped athlete 400.

In operation, the simulation follows the rules and practices, of the sport of soccer except to the extent that departures are required by the specific nature of the simulation. The operation will be described in terms of the preferred embodiments except when differences between embodiments require elaboration. It should be understood however that any of the embodiments are suitable for conducting the simulation.

According to one particular set of rules for simulating the sport of soccer, one team of eleven athletes 100 is deployed on each of the two halves of the field 10 as bisected by the center line 40. On each team, one of the eleven athletes 100 must be designated a goalkeeper. A simulated game lasts 90 scale minutes, divided into two equal halves. It has been found that a particularly desirable time scale of 4 real minutes to 15 simulated minutes facilitates games with, on average, the same range of scores found in real soccer games.

A team scores one point by "kicking" a small ball B into the opposing team's goal net 28, 30 either indirectly from any spot on the field 10 or directly from a spot within the opponent's half of the field 10. A direct kick is one in which the kicked ball enters the goal net 28, 30 without touching any player, except possibly the goalkeeper. An indirect kick is one in which the kicked ball is touched by some other player before proceeding on to the goalkeeper. If the game is tied after the end of the second half, the game may be decided through penalty kicks, as used in the sport of soccer, or through 4 minute periods of sudden-death overtime.

The usual method of moving the ball in the sport of soccer is kicking it. With reference to FIGS. 2 and 3, the method of simulating kicking a soccer ball will be described. The athlete 100 is placed adjacent to the ball (not shown) such that the leading edge 110 of the front panel 104 abuts or is closely adjacent to the ball. The player (not shown) then strikes or thrusts the fold 102 with a downward blow or push. The resulting force exerted on the fold 102 causes the front and rear panels 104, 106 to be driven outward, thereby propelling the ball analogously to a soccer player kicking a ball. After the "kick", the athlete returns to its original condition.

A coin toss decides which team kicks-off to start the half. During the kick-off, all athletes 100 must be on their own half of the field 10 and only the players 100 on the kick-off team are allowed into the center circle 42. The ball is placed at the very center of the field 10 and the kick-off player 100 must kick the ball upfield a distance equal to at least the circumference of the ball but no more than the radius of the center circle 42. The upfield direction is defined as being toward the opposing team's goal net 28, 30. The downfield direction is defined as being towards the athlete's 100 team's own goal net 28, 30.

After the kick-off, the kick-off team is allowed one downfield pass to make time to deploy its athletes 100 upfield. At no other time is an athlete 100 allowed to make a downfield pass back into its own half of the field 10.

The athlete 100 closest to the ball is deemed to have possession of the ball, so long as the ball is in play. If the ball is equidistant between athletes 100 from opposing teams, then possession of the ball is awarded to the athlete 100 from the team that last touched the ball. If the-ball is equidistant between athletes 100 from the same team, then the player controlling that team is free to decide which of those athletes 100 will take possession. The athlete 100 having possession of the ball is placed adjacent to the ball and oriented so as to kick the ball in the direction desired by the player.

After each kick, the athlete 100 that last kicked the ball is positioned within a 2 inch radius of its pre-kick position. Each player is further allowed to redeploy either one athlete 100 within a 6 inch radius of its current position or two athletes 100 within a 3-inch radius of each of their current positions. Except in the cases of a kick-off, a corner kick, a free kick, or a throw in, athletes 100 on the same team must at all times be deployed at least 3 inches apart. All 11 athletes 100 on a team may be deployed in that team's half of the field 10, but only 7 may be deployed at any given time in the opponent's half of the field 10. To keep the game moving briskly, the time between kicks is regulated to a maximum of about 5 seconds, depending upon the level of play.

In the sport of soccer, a player is ruled offside if, when the ball is played, he is closer to the opponent's goal than two opponents and the ball, unless: he is on his team's half of the field, an opponent played the ball last, or he received the ball directly from a goal kick, a corner kick, a throw in or a refereed ball drop. In the simulation, the offside rule is only applied when the athlete concerned 100 is within the opposing team's penalty area 36, 38.

In the sport of soccer, when the ball crosses either touchline, it is deemed out of play and the team opposing the last player to touch the in-play ball is awarded a throw in. In the simulation, a throw in is conducted by placing an athlete 100 along the touchline 12, 14 where the ball went out of play and having the player throw the ball against the front panel 104 of the athlete 100 to throw the ball back into play.

During a comer kick, only 5 invading athletes 100 are allowed in the defending team's penalty area 36, 38. The defending team can deploy up to 11 athletes 100 in its own penalty area 36, 38 and is not restricted to deploying them a minimum of 3 inches apart. The offside rules are temporarily suspended until the ball goes out of play after a comer kick.

Goal tending can be carded out using one of two methods. If a general athlete 100 is used as the goalkeeper, then the player moves the goalkeeper about with his hand to block shots on goal. However, if the ball strikes the player's hand, then a penalty kick will be awarded to the other team.

If a remotely controlled goalkeeper, such as a magnetic goalkeeper 800 is used, the player moves a control rod 850 to maneuver the goalkeeper 850 about the goal area 32, 34. As the player moves the control rod 850 below the field 10, the pair of control rod magnets 856*a*, 856*b* drag the goalkeeper magnet 840 attached to the goalkeeper 800, thereby dragging the whole of goalkeeper 800. By quickly rotating the control rod 850 about its longitudinal axis, a skillful player would be able to quickly rotate the polarity of the magnetic field of the control rod magnets 856*a*, 856*b* with respect to the goalkeeper magnet 840, thereby causing the goalkeeper 800 to jump off the field 10 as if lunging for the ball.

Although a specific embodiment of the present invention has been described and illustrated, the present invention is not limited to the features of this embodiment, but includes all variations and modifications within the scope of the claims.

For example, it is envisioned that similar athletes 100, 200, 300, 400 and goalkeepers 600, 700, 800 could be used for analogous projectile sports such as hockey. It is also envisioned that magnetic coupling between a control rod 650, 750, 850 and a gamepiece 600, 700, 800 could be used in simulating other sports.

The athletes 100, 200, 300, 400, 600, 700, 800 could be constructed in a number of different ways. Any of the front, back, top, or bottom panels could be joined to its neighbor by either a fold or a resilient joint. If a resilient joint were used, then the panels joined need not be resilient themselves. If the panels are resilient, then the joint need not be resilient. Neighboring panels might be formed from a unitary sheet or from separate sheets. If a neighboring panels met in a fold, the fold could either be reinforced or not reinforced. A resilient joint might be applied to neighboring panels in the form of tape or matting, or it might be fabricated from plastic, rubber, or sheet metal. It is also recognized that the athlete geometries presented 100, 200, 300, 400 are merely specific examples of a more general class of objects being characterized by a substantially concave down shape defined by a leading member and a trailing member that are resiliently connected.

It is also recognized that the athletes 100,200,300, 400, 600, 700, 800 described could be used to simulate the sport of soccer under different rules than those forth out herein.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. Soccer game apparatus comprising:

a representative playing field having soccer field indicia thereon;

a representative game ball operable to roll along said playing field;

a representative goal operable to receive the game ball; and a representative athlete operable to propel the game ball, wherein the athlete is characterized by a substantially concave down shape defined by a leading member having a leading portion and a trailing portion, a trailing member having a leading portion and a trailing portion, and means for connecting the trailing portion of the leading member to the leading portion of the trailing member such that downward force applied to the connecting means forces the leading portion of the leading member away from the trailing portion of the trailing member.

2. Soccer game apparatus as in claim 1, wherein the athlete is an inverted V shape.

3. Soccer game apparatus as in claim 1, wherein the athlete is a truncated inverted V shape.

4. Soccer game apparatus as in claim 1, wherein the athlete is an inverted U shape.

5. Soccer game apparatus as in claim 1, wherein the athlete is an inverted W shape.

6. Soccer game apparatus as in claim 1, wherein the leading member, the trailing member and the connecting means are portions of a unitary body.

7. Soccer game apparatus as in claim 1, wherein the leading member and the trailing member are constructed from substantially rigid material.

8. Soccer game apparatus as in claim 1, wherein the leading member and the trailing member are constructed from resilient material.

9. Soccer game apparatus as in claim 1, wherein the connecting means is constructed from a flexible strip.

10. Soccer game apparatus as in claim 1, wherein the connecting means is constructed from a substantially rigid strip.

11. Soccer game apparatus as in claim 1, wherein the athlete further includes:

a first magnet affixed to the inside surface of said trailing member.

12. Soccer game apparatus as in claim 11, further including an elongated control rod having a proximate end and a magnetic distal end; said control rod being operable to attract the first magnet to the magnetic distal end and thereby to drag the athlete.

13. Soccer game apparatus as in claim 12, further including a mounting block affixed to the representative playing field, said mounting block defining a slot for receiving and constraining the proximate end of the elongated control rod.

14. Soccer game apparatus as in claim 1, wherein the athlete further includes:

a bottom member having a leading portion and a trailing portion, and means for resiliently connecting the trailing portion of said bottom member to the trailing portion of the trailing member.

15. Soccer game apparatus as in claim 14, wherein the athlete further includes:

a first magnet affixed to the bottom member.

16. Soccer game apparatus as in claim 15, further including an elongated control rod having a proximate end and a magnetic distal end, said control rod being operable to attract the first magnet to the magnetic distal end, and thereby to drag the athlete.

17. Soccer game apparatus as in claim 16, further including a second magnet affixed to the inside surface of the leading member and operable to releasably couple the leading member to the bottom member.

18. A representative athlete for use in a sports simulation operable to propel a game projectile over a playing surface, wherein said athlete is characterized by a substantially concave-down shape defined by a leading member having a leading portion and a trailing portion, a trailing member having a leading portion and a trailing portion, and means for connecting the trailing portion of said leading member to the leading portion of said trailing member such that downward force applied to the connecting means forces the leading portion of the leading member away from the trailing portion of the trailing member.

19. An athlete as in claim 18, wherein said athlete is an inverted V shape.

20. An athlete as in claim 18, wherein said athlete is a truncated inverted V shape.

21. An athlete as in claim 18, wherein said athlete is an inverted U shape.

22. An athlete as in claim 18, wherein said athlete is an inverted W shape.

23. An athlete as in claim 18, wherein the leading member, the trailing member and the connecting means are portions of a unitary body.

24. An athlete as in claim 18, wherein the leading member and the trailing member are constructed from substantially rigid material.

25. An athlete as in claim 18, wherein the leading member and the trailing member are constructed from resilient material.

26. An athlete as in claim 18, wherein the connecting means is constructed from a flexible strip.

27. An athlete as in claim 18, wherein the connecting means is constructed from a substantially rigid strip.

28. An athlete as in claim 18, wherein said athlete further includes: a first magnet affixed to the inside surface of the trailing member.

29. An athlete as in claim 28, further including an elongated control rod having a proximate end and a magnetic distal end, said control rod being operable to attract the first magnet to the magnetic distal end.

30. An athlete as in claim 29, further including a mounting block defining a slot for receiving and constraining the proximate end of the elongated control rod.

31. An athlete as in claim 23, wherein said athlete further includes:

a bottom member having a leading portion and a trailing portion, and means for resiliently connecting the trailing portion of said bottom member to the trailing portion of the trailing member.

32. An athlete as in claim 31, wherein said athlete further includes:

a first magnet affixed to the bottom member.

33. An athlete as in claim 32, further including an elongated control rod having a proximate end and a magnetic distal end, said control rod being operable to attract the first magnet to the magnetic distal end.

34. An athlete as in claim 33, further including a second magnet affixed to the inside surface of the leading member and operable to releasably couple the leading member to the bottom member.

* * * * *